US011993918B2

(12) United States Patent
Furukawa et al.

(10) Patent No.: US 11,993,918 B2
(45) Date of Patent: May 28, 2024

(54) ELECTRIC CONSTRUCTION MACHINE

(71) Applicant: Hitachi Construction Machinery Tierra Co., Ltd., Koka (JP)

(72) Inventors: Yuuta Furukawa, Koka (JP); Hiroyuki Andou, Ritto (JP); Seiichi Kihara, Koka (JP); Kiwamu Takahashi, Moriyama (JP)

(73) Assignee: Hitachi Construction Machinery Tierra Co., Ltd., Koka (JP)

( * ) Notice: Subject to any disclaimer, the term of this patent is extended or adjusted under 35 U.S.C. 154(b) by 0 days.

(21) Appl. No.: 17/910,470

(22) PCT Filed: Mar. 16, 2021

(86) PCT No.: PCT/JP2021/010650
§ 371 (c)(1),
(2) Date: Sep. 9, 2022

(87) PCT Pub. No.: WO2022/054316
PCT Pub. Date: Mar. 17, 2022

(65) Prior Publication Data

US 2023/0128121 A1 Apr. 27, 2023

(30) Foreign Application Priority Data

Sep. 11, 2020 (JP) ..... 2020-152850

(51) Int. Cl.
*E02F 9/20* (2006.01)
*E02F 9/08* (2006.01)

(52) U.S. Cl.
CPC ..... *E02F 9/207* (2013.01); *E02F 9/0858* (2013.01)

(58) Field of Classification Search
CPC ..... E02F 9/207; E02F 9/0858
See application file for complete search history.

(56) References Cited

U.S. PATENT DOCUMENTS 4,587,383 A * 5/1986 Stoldt ..... B60M 7/00 254/277
2009/0134599 A1 5/2009 Bowsher

FOREIGN PATENT DOCUMENTS

CN 201818110 U 5/2011
CN 107816069 A 3/2018
(Continued)

OTHER PUBLICATIONS

International Search Report (PCT/ISA/210) issued in PCT Application No. PCT/JP2021/010650 dated May 18, 2021 with English translation (four (4) pages).
(Continued)

*Primary Examiner* — Carlos Amaya
(74) *Attorney, Agent, or Firm* — Crowell & Moring LLP

(57) ABSTRACT

A cable support device (14) for supporting an intermediate part of a power supply cable (13) is provided with a cable stand (16) attached to an upper revolving structure (3), an arm member (19) that is rotatably attached to the cable stand (16) to grip the power supply cable (13) on the tip end side and, and a locking mechanism (25) that is removably disposed in the cable stand (16) and in the arm member (19) to prohibit rotation of the arm member (19) relative to the cable stand (16). Thereby, the rotation of the arm member (19) relative to the cable stand (16) is prohibited by the locking mechanism (25), making it possible to prevent the power feeding cable (13) retained in the arm member (19) from contacting a cab (6).

9 Claims, 10 Drawing Sheets

(56) References Cited

FOREIGN PATENT DOCUMENTS

| | | | |
|---|---|---|---|
| JP | 2006-232261 | A | 9/2006 |
| JP | 2010-65445 | A | 3/2010 |
| JP | 2011-184007 | A | 9/2011 |
| JP | 2017-43980 | A | 3/2017 |
| JP | 2018-184783 | A | 11/2018 |

OTHER PUBLICATIONS

Japanese-language Written Opinion (PCT/ISA/237) issued in PCT Application No. PCT/JP2021/010650 dated May 18, 2021 (three (3) pages).
Chinese-language Office Action issued in Chinese Application No. 202180017828.6 dated Feb. 29, 2024 with English translation (15 pages).

* cited by examiner

ELECTRIC CONSTRUCTION MACHINE

TECHNICAL FIELD

The present invention relates to electric construction machines, such as a hydraulic excavator provided with an electric motor as a power source.

BACKGROUND ART

A hydraulic excavator as a representative example of a construction machine is provided with an automotive lower traveling structure, an upper revolving structure mounted via a revolving device on the lower traveling structure to be capable of revolving thereto and a working mechanism disposed on the front side of the upper revolving structure. In recent years, for suppressing global warming and air pollution, an electric hydraulic excavator provided with an electric motor as a power source has been put to practical use. This electric hydraulic excavator supplies hydraulic oil for operation to a hydraulic actuator by driving a hydraulic pump by the electric motor.

As to the electric hydraulic excavator, there are known two types of electric hydraulic excavators, one being provided with an electric motor as a power source to drive the electric motor by power supplied from an external power source, and the other being provided with an electric motor, a battery and a battery charger as a power source to drive the electric motor by power supplied from the battery. Also in the electric hydraulic excavator provided with the battery, the battery charger is required to be recharged by power from the external power source as needed.

In this way, the electric hydraulic excavator requires the power from the external power source for driving the electric motor and carries out the work in a state where a power feeding cable is connected to the electric motor or the battery charger. Therefore, the electric hydraulic excavator is required to prevent an event that the power feeding cable is stepped on by the lower traveling structure at the traveling or an event that the power feeding cable becomes involved in the upper revolving structure at the revolving thereof. On the other hand, there is proposed an electric hydraulic excavator in which a cable support device is disposed on the upper revolving structure and the power feeding cable is supported by the cable support device to suspend an intermediate part of the power feeding cable (refer to Patent Document 1)

PRIOR ART DOCUMENT

Patent Document

Patent Document 1: Japanese Patent Laid-Open No. 2010-65445 A

SUMMARY OF THE INVENTION

However, the cable support device according to the conventional technology is provided with an arm a base end of which is attached on the upper revolving structure to be rotatable in a horizontal direction and on a tip end of which the power feeding cable is retained. Therefore, when the upper revolving structure is revolved in a state where the power feeding cable is retained on the tip end of the arm, the tip end of the arm comes close to a structural object of a cab or the like. Therefore, there occurs a problem that when the power feeding cable retained in the tip end of the arm contacts the structural object of the cab or the like, the power feeding cable is damaged.

Further, there is a problem that at the time of loading the electric hydraulic excavator on a transport vehicle for transport, the arm inadvertently rotates, whereby the tip end of the arm interferes with an obstacle in the surroundings, causing the obstacle to be broken down. In contrast, in a case of fixing the arm in a storage position for getting out of the way of transport, the work of fixing the arm in the storage position using exclusive jigs, tools and the like is required, causing a problem that operability at the transporting deteriorates.

An object of the present invention is to provide an electric construction machine that can prevent a power feeding cable retained on an arm member from contacting a structural object in the surroundings and improve the operability at the transporting.

An aspect of the present invention is provided with an electric construction machine comprising: an automotive lower traveling structure; an upper revolving structure mounted on the lower traveling structure to be capable of revolving thereto; an electric motor as a power source disposed on the upper revolving structure; and a cable support device configured to support an intermediate part of a power feeding cable for supplying power from an external power source to the electric motor, characterized in that the cable support device includes: a shaft body that is attached on the upper revolving structure in a state where a shaft center of the shaft body extends in an upper-lower direction; an arm member that is attached on the shaft body to be rotatable about the shaft center and grips the power feeding cable on the tip end side; and a locking mechanism disposed to be removable between the shaft body and the arm member to prohibit rotation of the arm member relative to the shaft body.

According to the aspect of the present invention, the rotation of the arm member relative to the shaft body attached on the upper revolving structure is prohibited by the locking mechanism. As a result, the arm member is fixed to the upper revolving structure, making it possible to prevent the arm member from contacting the structural object disposed on the upper revolving structure, at the revolving of the upper revolving structure. In addition, at the time of loading the electric hydraulic excavator on the transport vehicle, the arm member can be prevented from interfering with the obstacle in the surroundings due to the inadvertent rotation of the arm member, making it possible to improve the workability at the transporting.

MODE FOR CARRYING OUT THE INVENTION

Figure 1:
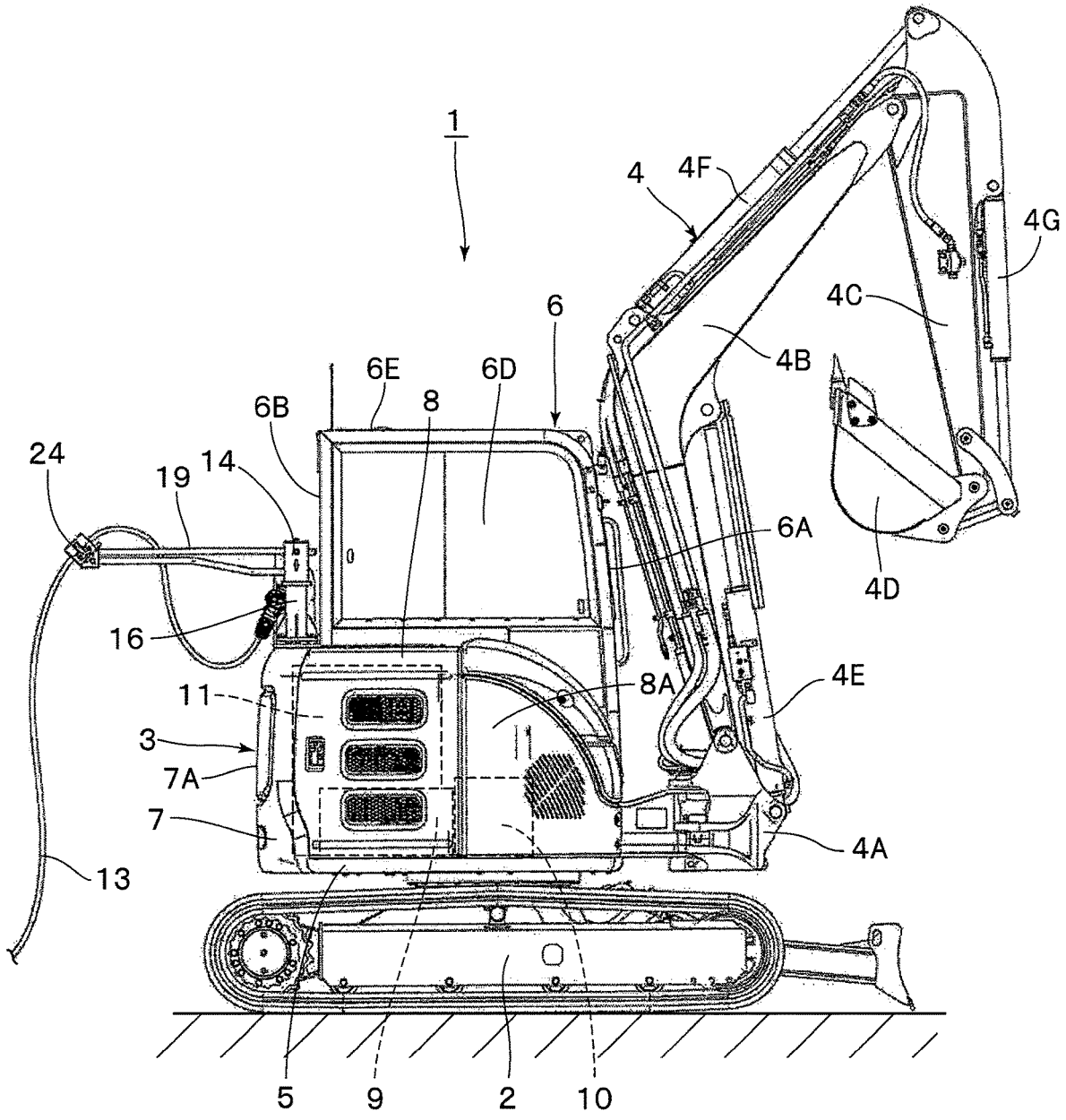
FIG. 1 is a right side view showing an electric hydraulic excavator according to an embodiment of the present invention in a state where an arm member in a cable support device is fixed in a cable gripping position.

Hereinafter, electric construction machines according to embodiments of the present invention will be in detail explained referring to FIG. 1 to FIG. 12 by taking a case of being applied to electric hydraulic excavators as an example. It should be noted that an explanation will be made of the embodiments by defining a traveling direction of the electric hydraulic excavator as a front-rear direction and a direction perpendicular to the traveling direction as a left-right direction.

An electric hydraulic excavator 1 representative of an electric construction machine is provided with an automotive lower traveling structure 2 of a crawler type in the front-rear direction and an upper revolving structure 3 mounted on the lower traveling structure 2 to be capable of revolving thereto. A vehicle body of the electric hydraulic excavator 1 is configured of the lower traveling structure 2 and the upper revolving structure 3. A swing type working mechanism 4 is disposed on the front side of the upper revolving structure 3. The working mechanism 4 is used to carry out an excavating work of earth and sand or the like.

The swing type working mechanism 4 is provided with a swing post 4A disposed on the front side of a revolving frame 5 to be described later to be capable of swinging in the left-right direction. A boom 4B is attached on the swing post 4A to be rotatable thereto, and an arm 4C is attached on a tip end of the boom 4B to be rotatable thereto, and a bucket 4D is attached on a tip end of the arm 4C to be rotatable thereto. In addition, the working mechanism 4 is provided with a swing cylinder (not shown) for swinging the swing post 4A, a boom cylinder 4E for rotating the boom 4B, an arm cylinder 4F for rotating the arm 4C, and a bucket cylinder 4G for rotating the bucket 4D.

The upper revolving structure 3 is mounted via a revolving device on the lower traveling structure 2 to be capable of revolving thereto and carries out a revolving movement on the lower traveling structure 2. The upper revolving structure 3 is provided with the revolving frame 5 as a base. The revolving frame 5 is provided with a cab 6, a counterweight 7, an exterior cover 8, an electric motor 9, a hydraulic pump 10, a battery 11 and the like mounted thereon.

The cab 6 is disposed on the left side of the revolving frame 5. The cab 6 is formed in a boxy shape to be surrounded by a front surface 6A, a rear surface 6B, a left side surface 6C, a right side surface 6D and an upper surface 6E, forming an operator's room on which an operator gets. An operator's seat for the operator to sit on, a traveling lever pedal for controlling a travel of the lower traveling structure, working operational levers for the revolving movement of the upper revolving structure 3 and the movement of the working mechanism 4, and the like (none of them are shown) are arranged in the cab 6.

The counterweight 7 is positioned closer to the rear side than the cab 6 to be disposed in the rear end of the revolving frame 5. The counterweight 7 acts as a weight balance to the working mechanism 4. A rear surface 7A of the counterweight 7 is formed in an arc shape in such a manner that a central part of the rear surface 7A in the left-right direction projects backward. Thereby, when the upper revolving structure 3 revolves, the rear surface 7A of the counterweight 7 is accommodated within a constant revolving radius.

The counterweight 7 rises upward from the rear end of the revolving frame 5 to cover the battery 11 and the like from the backward. An extension part 7B is formed on an upper end of the counterweight 7 to extend forward, and the rear side of the cab 6 is supported by the extension part 7B. In addition, a power feeding port 12 to be described later is disposed on the left end side of the extension part 7B, and a cable support device 14 to be described later is disposed on the right end side of the extension part 7B.

The exterior cover 8 is positioned in front of the counterweight 7 and is disposed on the revolving frame 5. The exterior cover 8 covers the electric motor 9, the hydraulic pump 10, the battery 11 and the like together with the counterweight 7. The exterior cover 8 includes a right exterior cover 8A for covering the electric motor 9, the hydraulic pump 10, the battery 11 and the like from the right side and the upper side, and a left exterior cover (not shown) for covering the battery 11 and the like from the left side.

The power feeding port 12 is disposed on the left end side of the extension part 7B in the counterweight 7. A power feeding cable 13 extending from an external power source (not shown) is connected to the power feeding port 12. The power feeding port 12 is retained by a cubic casing 12A projecting upward from the extension part 7B and extends obliquely downward from the upper side of the extension part 7B. The battery charger (not shown) is disposed within the exterior cover 8 to charge the battery 11 with power from the external power source, and connection between the battery charger and the power feeding port 12 is established via a cable (not shown).

In a state where the power feeding cable 13 is connected to the power feeding port 12, the power from the external power source is supplied via the battery charger, a motor controlling device and the like (none of them are shown) to the electric motor 9, and the battery 11 is charged with the extra power. Accordingly, in a state where the power feeding cable 13 is connected to the power feeding port 12, the electric motor 9 is driven by the power from the external power source to drive the hydraulic pump 10. The electric hydraulic excavator 1 carries out an excavating work of earth and sand, and the like by using the working mechanism 4 while revolving the upper revolving structure 3 in a state where the power feeding cable 13 is connected to the power feeding port 12. At this time, the intermediate part of the power feeding cable 13 connected to the power feeding port 12 is supported by the cable support device 14.

Next, an explanation will be made of the cable support device 14 according to the present embodiment.

Figure 3:
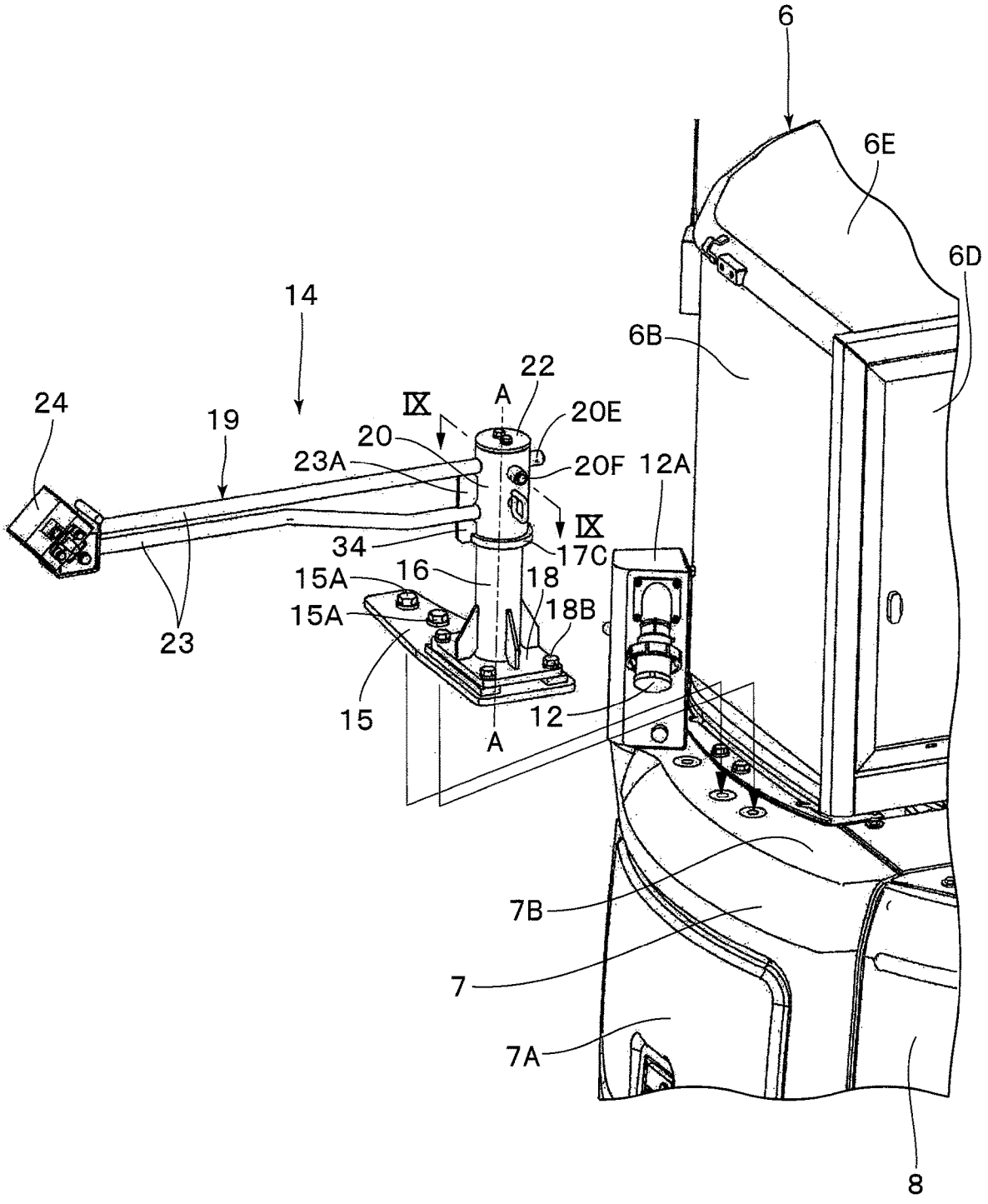
FIG. 3 is an exploded perspective view showing the cable support device and an upper revolving structure.
Figure 4:
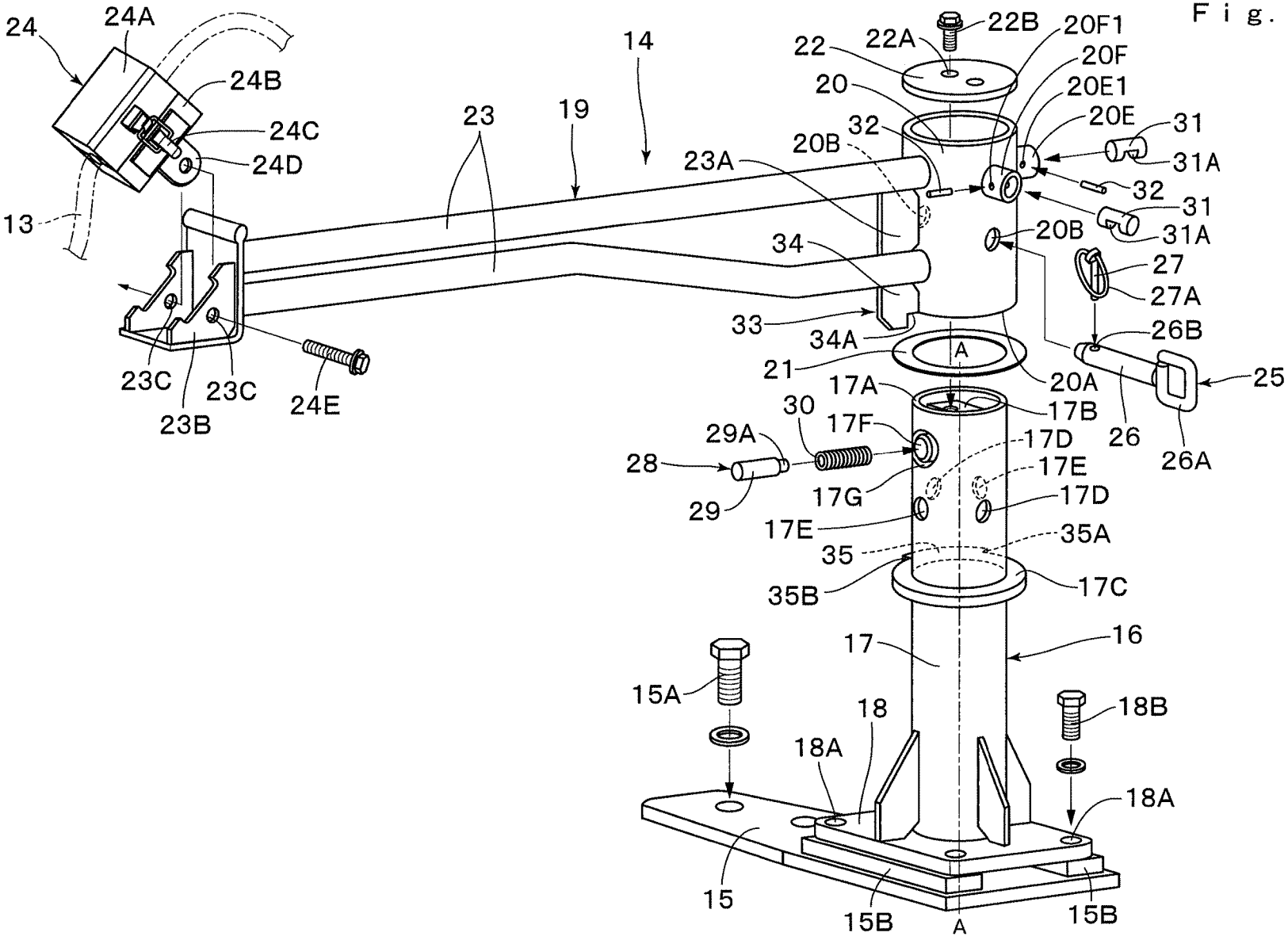
FIG. 4 is an exploded perspective view showing the cable support device.

The cable support device 14 is disposed on the upper revolving structure 3 and supports the intermediate part of the power feeding cable 13 connected to the power feeding port 12. As shown in FIG. 3, the cable support device 14 is disposed on the extension part 7B of the counterweight 7 together with the power feeding port 12. As shown in FIG. 4, the cable support device 14 includes an attaching base 15, a cable stand 16, an arm member 19, a locking mechanism 25, a stopper 28, and a rotation restricting portion 33, which will be described later.

The attaching base 15 is disposed on the extension part 7B of the counterweight 7. The attaching base 15 is composed of a flat-shaped plate body extending in the left-right direction of the counterweight 7 and is attached on the upper surface of the extension part 7B by using bolts 15A. A plurality of screw seating 15B are arranged on a right upper surface of the attaching base 15.

The cable stand 16 as a shaft body is attached via the attaching base 15 on the counterweight 7 of the upper revolving structure 3 in a state where the shaft center A-A extends in the upper-lower direction. The cable stand 16 includes a stand main body 17 formed in a hollow cylindrical shape using a pipe material, and a flat-shaped end plate 18 fixed on a lower end of the stand main body 17. A bolt through hole 18A is formed in each of four corner parts of the end plate 18, and a bolt 18B inserted in the bolt through hole 18A is threaded into the screw seating 15B of the attaching base 15. As a result, the end plate 18 is attached on the attaching base 15, and the stand main body 17 is positioned on the oblique rear side of the corner part where the rear surface 6B and the right side surface 6D of the cab 6 intersect and is attached on the extension part 7B of the counterweight 7.

The upper end of the stand main body 17 is formed as an opening end 17A. A screw seating 17B positioned under the opening end 17A is disposed in the inside of the stand main body 17 (refer to FIG. 7). A disc-shaped flange part 17C having an outer diameter dimension larger than the stand main body 17 is disposed in the intermediate part of the stand main body 17 in the length direction (upper-lower direction). The flange part 17C rotatably supports a cylindrical part 20 of the arm member 19 to be described later from under. A pair of first shaft body side lock holes 17D and a pair of second shaft body side lock holes 17E are arranged closer to the upper side than the flange part 17C, of the stand main body 17 to radially penetrate through the stand main body 17. The first shaft body side lock holes 17D and the second shaft body side lock holes 17E are arranged to be perpendicular to each other. The first shaft body side lock holes 17D and the second shaft body side lock holes 17E configure part of the locking mechanism 25.

Figure 9:
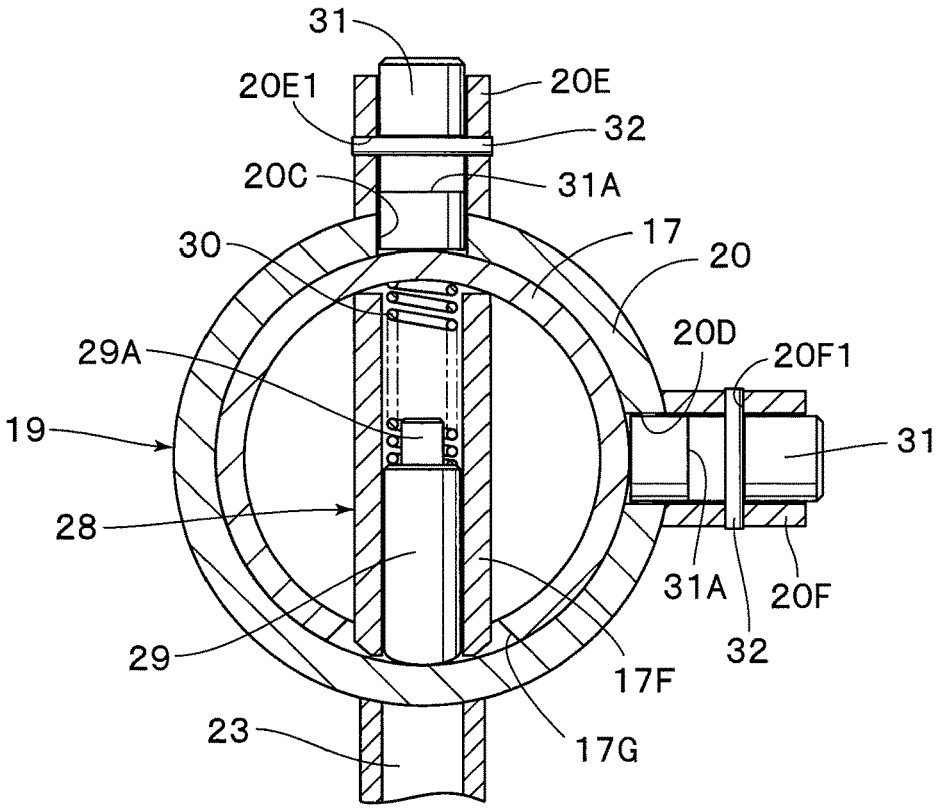
FIG. 9 is a cross section showing a shaft body side stopper hole, an arm side stopper hole, an engaging pin, a compression spring and the like configuring a stopper, as viewed from an arrow IX-IX direction in FIG. 3.

A shaft body side stopper hole 17F in a cylindrical shape is disposed in the inside of the stand main body 17 to be positioned closer to the lower side than the screw seating 17B. As shown in FIG. 9, the shaft body side stopper hole 17F is formed by a tubular body inserted through a radial hole 17G in the stand main body 17. The shaft body side stopper hole 17F extends in a direction (radial direction) perpendicular to the shaft center A-A of the cable stand 16. One end of the shaft body side stopper hole 17F opens through the radial hole 17G to an outer peripheral surface of the stand main body 17. The other end of the shaft body side stopper hole 17F is closed by an inner peripheral surface of the stand main body 17. The shaft body side stopper hole 17F configures part of the stopper 28.

The arm member 19 is attached on the cable stand 16 to be rotatable about the shaft center A-A. The arm member 19 extends in a direction where the tip end side is away from the shaft center A-A of the cable stand 16. The arm member 19 and grips the intermediate part of the power feeding cable 13 by a cable clamp 24 to be described later. The arm member 19 includes the cylindrical part 20, a stay 23, and the cable clamp 24.

The cylindrical part 20 is engaged with the stand main body 17 of the cable stand 16 to be rotatable thereto. The cylindrical part 20 has an inner diameter dimension larger than an outer diameter of the stand main body 17 and is formed by a pipe body of which both ends in the length direction open. The cylindrical part 20 is rotatably engaged with the outer peripheral side of the stand main body 17, and a lower end 20A of the cylindrical part 20 is rotatably supported by the flange part 17C of the stand main body 17. An annular seat material (low-friction seat) 21 is disposed between the lower end 20A of the cylindrical part 20 and the flange part 17C, and a slide friction at the time the cylindrical part 20 rotates is reduced by this seat material 21.

A lid body 22 is attached on the upper end of the stand main body 17 in a state where the lower end 20A of the cylindrical part 20 is supported on the flange part 17C. The lid body 22 is composed of a disc plate having a diameter equal to an outer diameter dimension of the cylindrical part 20, and two bolt through holes 22A are formed in the lid body 22 to penetrate therethrough in the upper-lower direction. A bolt 22B is inserted in each of the two bolt through holes 22A, and by threading the bolt 22B into the screw seating 17B of the stand main body 17, the lid body 22 is fixed on the upper end of the stand main body 17. Thereby, the cylindrical part 20 of the arm member 19 is prevented from falling out of the stand main body 17, and the opening end 17A of the stand main body 17 is lidded by the lid body 22.

A pair of arm side lock holes 20B are disposed in the cylindrical part 20 to penetrate through the cylindrical part 20 radially. The pair of arm side lock holes 20B configure part of the locking mechanism 25. A height dimension from the lower end 20A to the arm side lock hole 20B of the cylindrical part 20 is set to be equal to a height dimension from the flange part 17C to the first shaft body side lock hole 17D and the second shaft body side lock hole 17E of the stand main body 17. Accordingly, by rotating the cylindrical part 20 about the shaft center A-A of the cable stand 16, the pair of arm side lock holes 20B correspond to the first shaft body side lock holes 17D or the second shaft body side lock holes 17E of the stand main body 17.

A first arm side stopper hole 20C and a second arm side stopper hole 20D are arranged on part of the cylindrical part 20 closer to the upper side than the pair of arm side lock holes 20B (refer to FIG. 9). The first arm side stopper hole 20C and the second arm side stopper hole 20D each have an inner diameter dimension equal with each other. The first arm side stopper hole 20C and the second arm side stopper hole 20D are arranged by intervals of 90 degrees in the circumferential direction of the cylindrical part 20 and configure part of the stopper 28. A height dimension from the lower end 20A to the first arm side stopper hole 20C and the second arm side stopper hole 20D of the cylindrical part 20 is set to be equal to a height dimension from the flange part 17C to the shaft body side stopper hole 17F of the stand main body 17. Accordingly, by rotating the cylindrical part 20 about the shaft center A-A of the cable stand 16, the first arm side stopper hole 20C and the second arm side stopper hole 20D correspond to the shaft body side stopper hole 17F.

A cylindrical first collar 20E and a cylindrical second collar 20F are fixed on an outer peripheral surface of the cylindrical part 20 on the upper end side by means of welding or the like. The first collar 20E is composed of a cylindrical body having an inner diameter dimension equal to the first arm side stopper hole 20C and is disposed to be concentric with the first arm side stopper hole 20C. A pin hole 20E1 is formed in the intermediate part of the first collar 20E in an axial direction to radially penetrate therethrough. A bush pin 31 to be described later is disposed in the inside of the first collar 20E, and a retaining pin 32 to be described later is attached in the pin hole 20E1. The second collar 20F is composed of a cylindrical body having an inner diameter dimension equal to the second arm side stopper hole 20D and is disposed to be concentric with the second arm side stopper hole 20D. A pin hole 20F1 is formed in the intermediate part of the second collar 20F in an axial direction to radially penetrate therethrough. The bush pin 31 is disposed in the inside of the second collar 20F, and the retaining pin 32 is attached in the pin hole 20F1.

The stay 23 configuring the arm member 19 is disposed to be integral with the cylindrical part 20. The stay 23 is formed by two cylindrical bodies connected via a reinforcing plate 23A to be neighbored with each other in the upper-lower direction. A base end of the stay 23 is welded to the outer peripheral surface of the cylindrical part 20 together with the reinforcing plate 23A in a position separated by 180 degrees in the circumferential direction from the first collar 20E, for example. A tip end side of the stay 23 extends in a direction away from the shaft center A-A of the cable stand 16 and grips the intermediate part of the power feeding cable 13 via the cable clamp 24. Clamp attaching parts 23B are disposed on the tip end of the stay 23, and bolt through holes 23C are formed in the clamp attaching parts 23B respectively.

The cable clamp 24 is disposed on the tip end of the stay 23. The cable clamp 24 includes a pair of clamping members 24A, 24B to be capable of opening or closing by a hinge mechanism (not shown), and a lock 24C. The pair of clamping members 24A, 24B are opened or closed on a basis of the hinge mechanism between a closed position of gripping the power feeding cable 13 by holding it therebetween from an outer periphery side thereof and an opened position of releasing the power feeding cable 13. The lock 24C fixes the power feeding cable 13 to the closed position where the power feeding cable 13 is gripped by locking the pair of clamping members 24A, 24B. A bracket 24D is disposed in the clamp member 24B as one of the clamping members 24A, 24B. The bracket 24D is attached on the clamp attaching part 23B of the stay 23 by using a bolt 24E. Thereby, the cable clamp 24 is attached on the tip end of the stay 23, and by opening or closing the clamp members 24A, 24B of the cable clamp 24, the power feeding cable 13 can easily be removed from or attached to the cable support device 14.

The locking mechanism 25 is disposed between the cable stand 16 and the arm member 19 and prohibits the rotation of the arm member 19 relative to the cable stand 16. Specifically, the locking mechanism 25 includes the first shaft body side lock holes 17D and the second shaft body side lock holes 17E that are disposed in the stand main body 17, and the arm side lock holes 20B and a lock pin 26 that are arranged in the cylindrical part 20.

Figure 2:
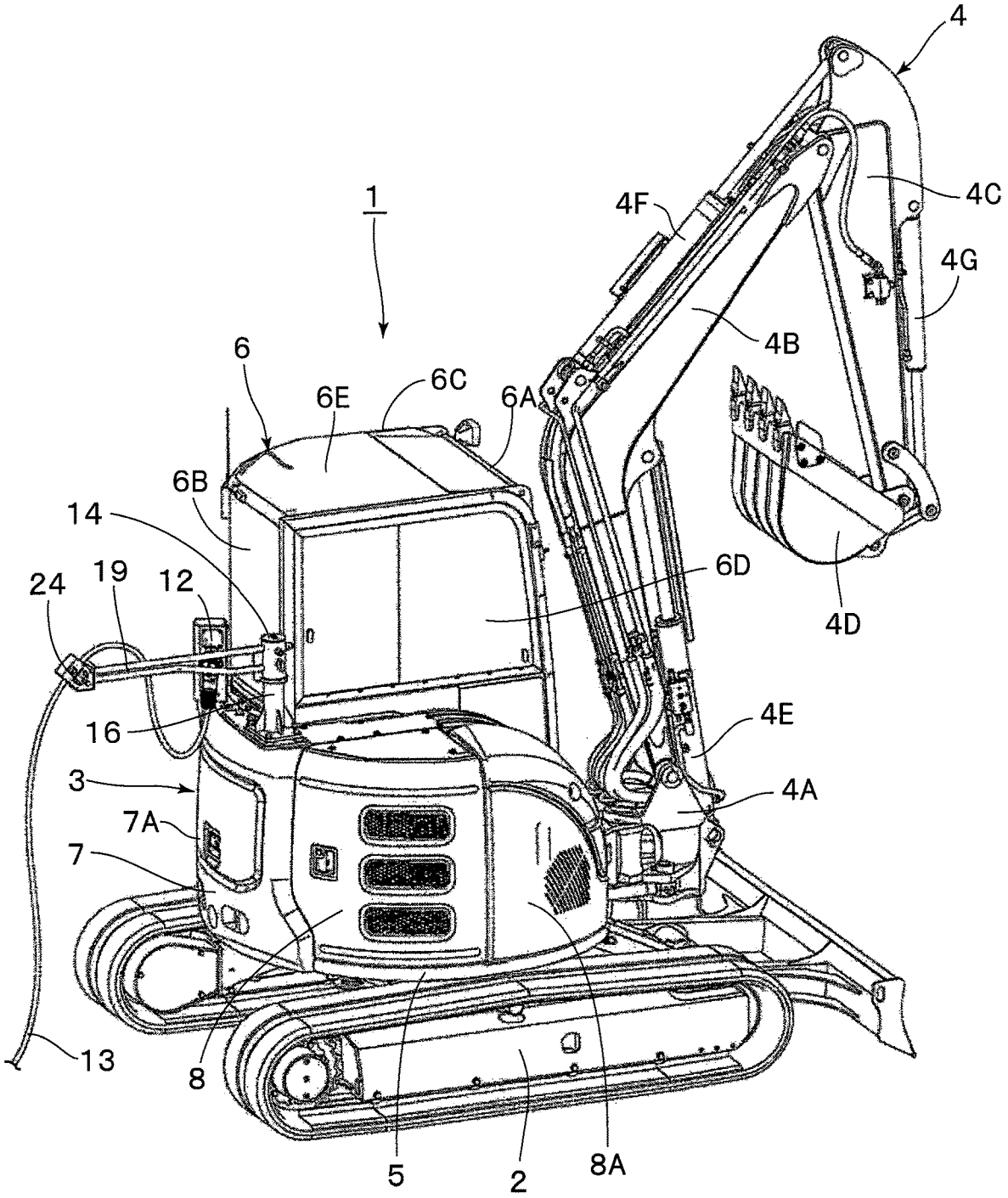
FIG. 2 is a perspective view showing the electric hydraulic excavator in FIG. 1 as viewed from the right rear side
Figure 5:
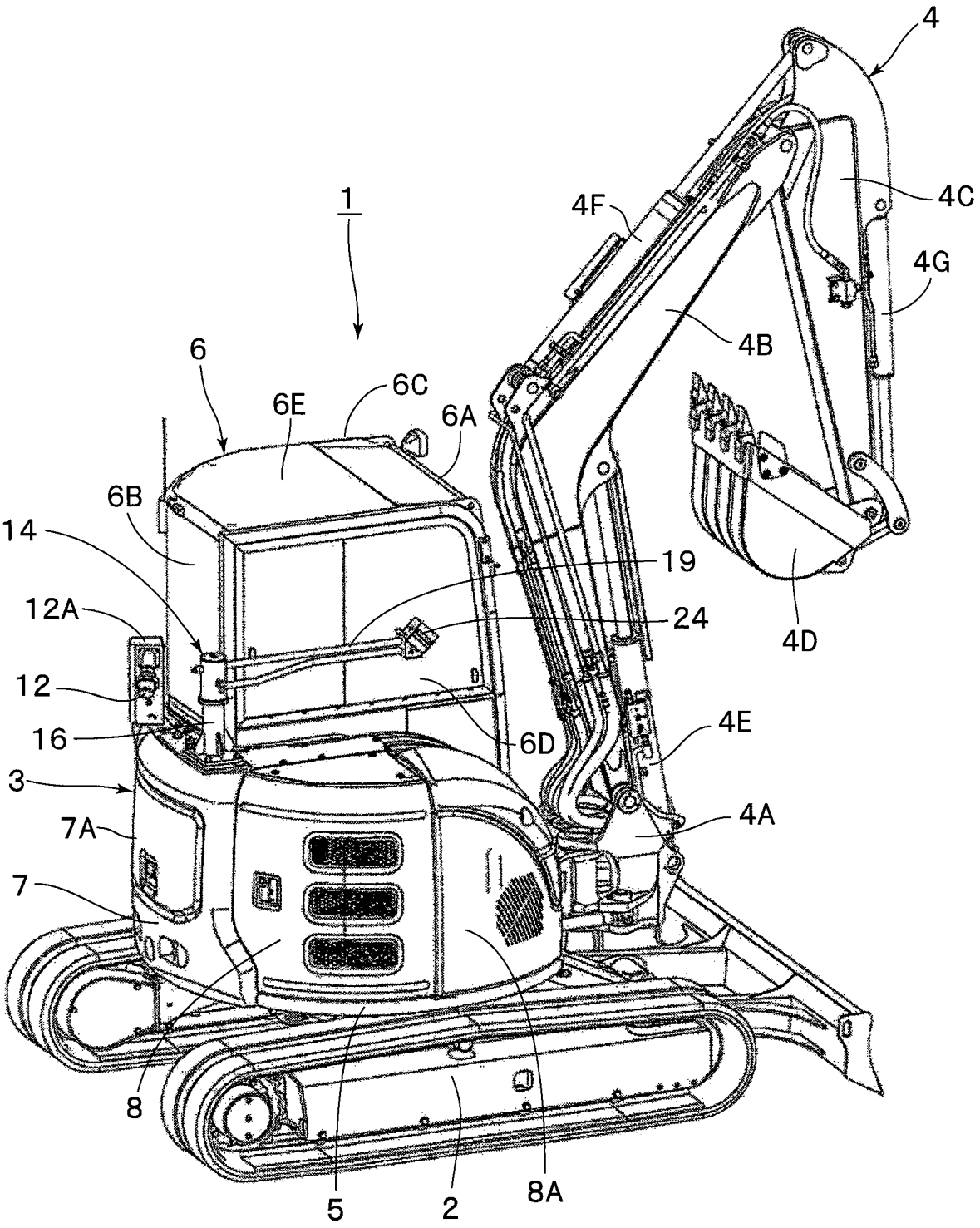
FIG. 5 is a perspective view showing the electric hydraulic excavator in a state where the arm member is fixed in a cab-lateral storage position.
Figure 6:
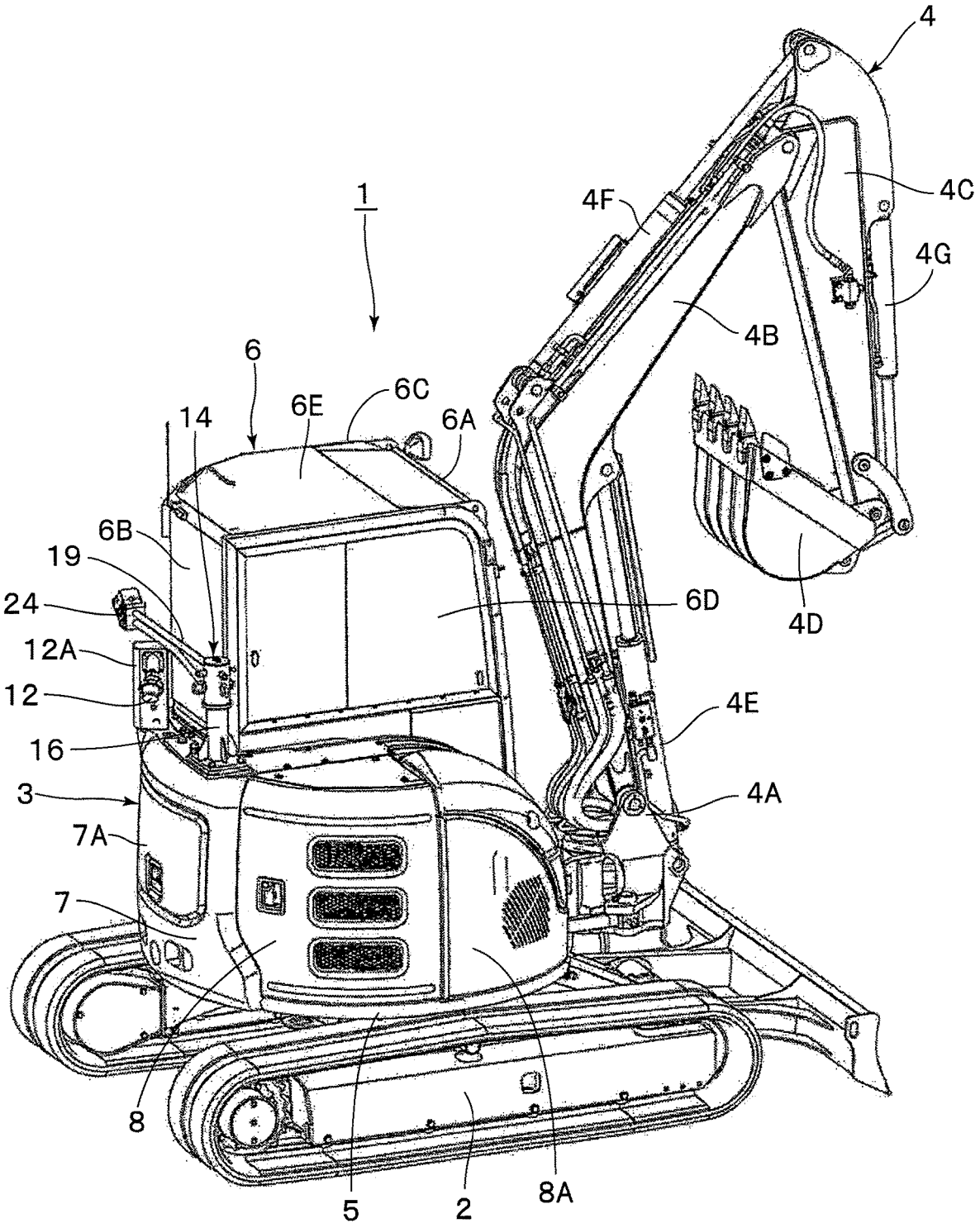
FIG. 6 is a perspective view showing the electric hydraulic excavator in a state where the arm member is fixed in a cab-backward storage position.

The lock pin 26 is composed of a columnar shaft body, and a gripper 26A in a D-letter shape to be gripped by a worker is disposed in a base end of the lock pin 26. The lock pin 26 prohibits the rotation of the arm member 19 relative to the cable stand 16 by insert of the lock pin 26 in the arm side lock holes 20B disposed in the cylindrical part 20, the first shaft body side lock holes 17D or the second shaft body side lock holes 17E disposed in the stand main body 17. Thereby, the arm member 19 is optionally fixed in any one of the three positions composed of the cable gripping position as shown in FIG. 1 and FIG. 2, the cab-lateral storage position as shown in FIG. 5, and the cab-backward storage position as shown in FIG. 6. A pin hole 26B is formed on the tip end side of the lock pin 26 to penetrate therethrough radially, and the lock pin 26 is prevented from axially falling out by a ring pin 27 to be inserted in the pin hole 26B. The ring pin 27 is provided with an annular ring 27A. The ring 27A is attached on the ring pin 27 in a position where both ends thereof are separated from each other, thus generating a torsional force. The ring 27A is pushed on an outer peripheral surface of the ring pin 27 with an appropriate force by its own torsional force.

When the lock pin 26 is inserted in the arm side lock holes 20B and the first shaft body side lock holes 17D, the arm member 19 is fixed in the cable gripping position (position in FIG. 1 and FIG. 2). In the cable gripping position, the stay 23 of the arm member 19 extends backward from the counterweight 7 and the power feeding cable 13 connected to the power feeding port 12 is gripped by the cable clamp 24. Accordingly, in a state where the arm member 19 is fixed in the cable gripping position, the electric motor 9 is driven by the power supplied via the power feeding cable 13 from the external power source, and the battery 11 is charged with the extra power. Thereby, the electric hydraulic excavator 1 is used, making it possible to carry out the excavating work or the like.

In addition, in a state where the arm member 19 is rotated by 180 degrees from the cable gripping position, when the lock pin 26 is inserted in the arm side lock holes 20B and the first shaft body side lock holes 17D, the arm member 19 is fixed in the cab-lateral storage position (position in FIG. 5). In the cab-lateral storage position, the stay 23 is disposed to extend along the right side surface 6D of the cab 6 in the front-rear direction. When the electric hydraulic excavator 1 is operated by the power from the battery 11 or when the electric hydraulic excavator 1 is loaded on the transport vehicle, the arm member 19 is stored in the cab-lateral storage position in a state where the power feeding cable 13 is removed from the power feeding port 12.

Further, in a state where the arm member 19 is rotated by 90 degrees clockwise from the cable gripping position, when the lock pin 26 is inserted in the arm side lock holes 20B and the second shaft body side lock holes 17E, the arm member 19 is fixed in the cab-backward storage position (position in FIG. 6). In the cab-backward storage position, the stay 23 is disposed to extend along the rear surface 6B of the cab 6 in the left-right direction. When the electric hydraulic excavator 1 is loaded on the transport vehicle, the arm member 19 is stored in the cab-backward storage position in a state where the power feeding cable 13 is removed from the power feeding port 12.

Figure 8:
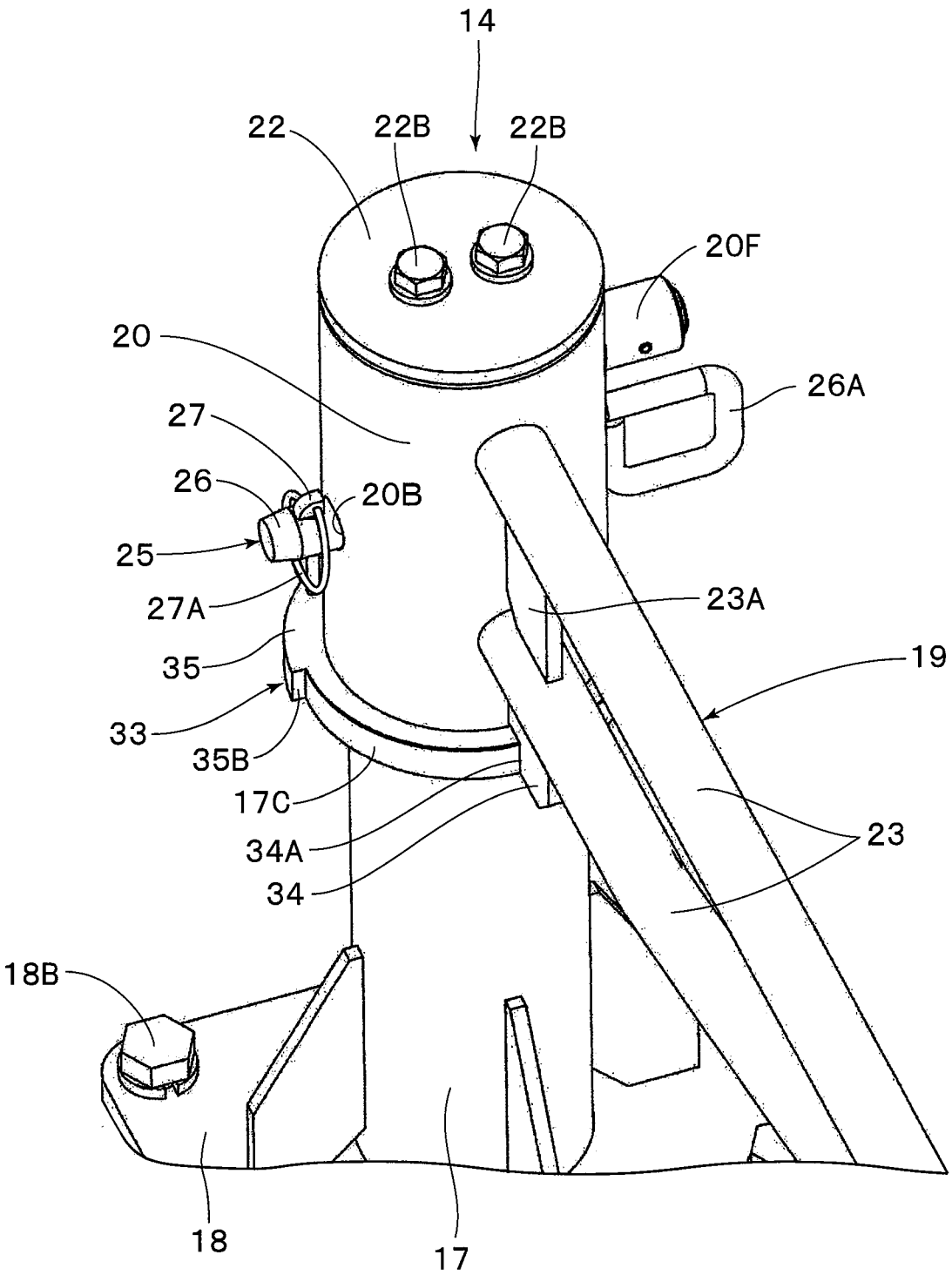
FIG. 8 is a perspective view showing a state where rotation of the arm member is prohibited by a locking mechanism.

In this way, when the lock pin 26 is inserted in the arm side lock holes 20B and the first shaft body side lock holes 17D or in the arm side lock holes 20B and the second shaft body side lock holes 17E, the arm member 19 is fixed in any one of the cable gripping position, the cab-lateral storage position and the cab-backward storage position. Here, as a case where the arm member 19 is fixed in the cable gripping position is taken as an example, as shown in FIG. 8, the tip end side of the lock pin 26 projects from the arm side lock hole 20B, and the ring pin 27 is inserted in the pin hole 26B disposed on this tip end side. Thereby, the lock pin 26 is prevented from axially falling out, and the arm member 19 is fixed in the cable gripping position. As similar to this, the lock pin 26 is prevented from axially falling out by the ring pin 27 in a state where the arm member 19 is fixed in the cab-lateral storage position or in the cab-backward storage position.

A stopper 28 is disposed between the cable stand 16 and the arm member 19. The stopper 28 automatically stops the cylindrical part 20 of the arm member 19, which rotates relative to the stand main body 17 of the cable stand 16, in a predetermined position. As shown in FIG. 9 to FIG. 12, the stopper 28 includes the shaft body side stopper hole 17F disposed in the stand main body 17, the first arm side stopper hole 20C and the second arm side stopper hole 20D disposed in the cylindrical part 20, an engaging pin 29, and a compression spring 30.

The engaging pin 29 is disposed to be axially movable within the shaft body side stopper hole 17F. The engaging pin 29 is formed in a columnar shape to slidably engage with the shaft body side stopper hole 17F, and a small diameter part 29A thereof is disposed in a base end of the engaging pin 29. The compression spring 30 as a pin urging member is disposed in the depth of the shaft body side stopper hole 17F. Specifically, the compression spring 30 is disposed between an inner peripheral surface of the stand main body 17 and the small diameter part 29A of the engaging pin 29 and always urges (presses) the engaging pin 29 in a direction of projecting from the shaft body side stopper hole 17F.

When the arm member 19 is in the cable gripping position, as shown in FIG. 9 the shaft body side stopper hole 17F does not correspond to any one of the first arm side stopper hole 20C and the second arm side stopper hole 20D. At this time, the tip end of the engaging pin 29 abuts on the inner peripheral surface of the stand main body 17. When the arm member 19 rotates relative to the cable stand 16 from this state, the shaft body side stopper hole 17F corresponds to the first arm side stopper hole 20C or the second arm side stopper hole 20D.

Figure 10:
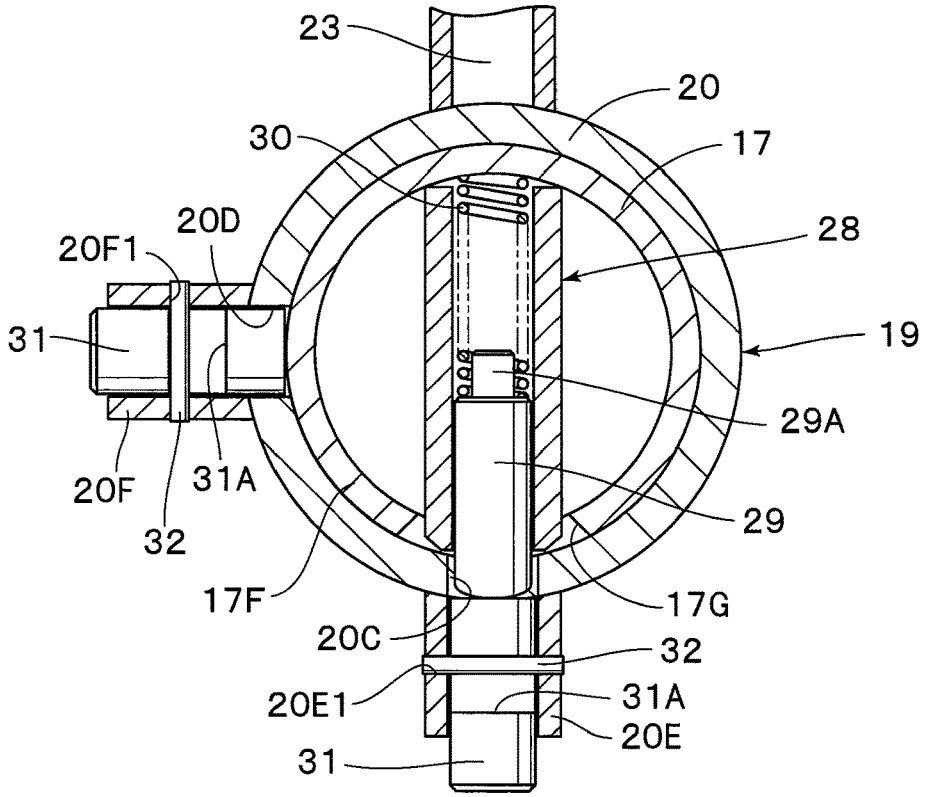
FIG. 10 is a cross section showing, in the same position as in FIG. 9, a state where the arm member is stopped in the cab-lateral storage position by the stopper.

When the arm member 19 moves to the cab-lateral storage position, as shown in FIG. 10 the shaft body side stopper hole 17F corresponds to the first arm side stopper hole 20C. Thereby, the engaging pin 29 projects from the shaft body side stopper hole 17F by the urging force of the compression spring 30 to be engaged with the first arm side stopper hole 20C. In this way, the stopper 28 stops the arm member 19 in the predetermined cab-lateral storage position by the engagement of the engaging pin 29 with the first arm side stopper hole 20C by the compression spring 30.

Figure 11:
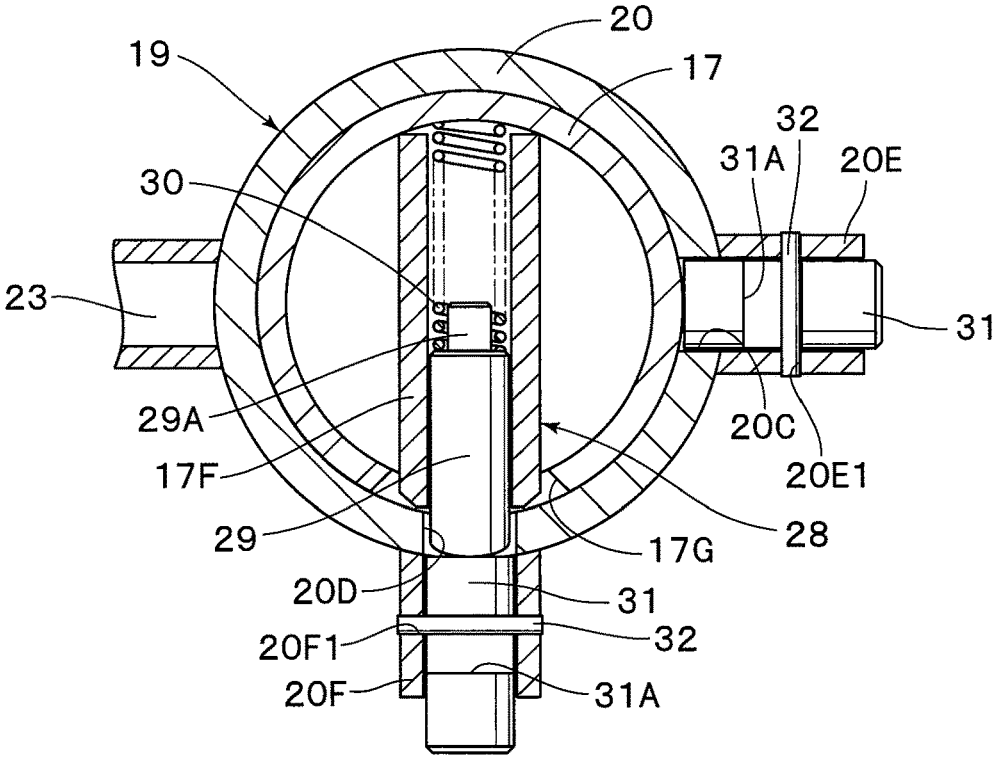
FIG. 11 is a cross section showing, in the same position as in FIG. 9, a state where the arm member is stopped in the cab-backward storage position by the stopper.

On the other hand, when the arm member 19 moves to the cab-backward storage position, as shown in FIG. 11 the shaft body side stopper hole 17F corresponds to the second arm side stopper hole 20D. Thereby, the engaging pin 29 projects from the shaft body side stopper hole 17F by the urging force of the compression spring 30 to be engaged with the second arm side stopper hole 20D. In this way, the stopper 28 stops the arm member 19 in the predetermined cab-lateral storage position by the engagement of the engaging pin 29 with the second arm side stopper hole 20D by the compression spring 30.

The bush pins 31 are arranged on an inner peripheral side of the first collar 20E and on an inner peripheral side of the second collar 20F of the cylindrical part 20 to be respectively movable therein. The bush pin 31 is formed by a columnar shaft body having an outer diameter dimension equal to the engaging pin 29, for example, and is engaged with each of the inner peripheral side of the first collar 20E and the inner peripheral side of the second collar 20F to be axially slidable therein. A recessed groove 31A is formed in an axially intermediate part of the bush pin 31, the recessed groove 31A being formed by notching an outer peripheral surface of the bush pin 31 toward the shaft center. The retaining pin 32 is attached in the pin hole 20E1 of the first collar 20E in a state where the bush pin 31 is engaged with the first collar 20E therein. Similarly, the retaining pin 32 is attached in the pin hole 20F1 of the second collar 20F in a state where the bush pin 31 is engaged with the second collar 20F therein. Accordingly, the bush pin 31 is prevented from falling out of the first collar 20E and the second collar 20F by the abutment of the recessed groove 31A on the retaining pin 32.

Figure 12:
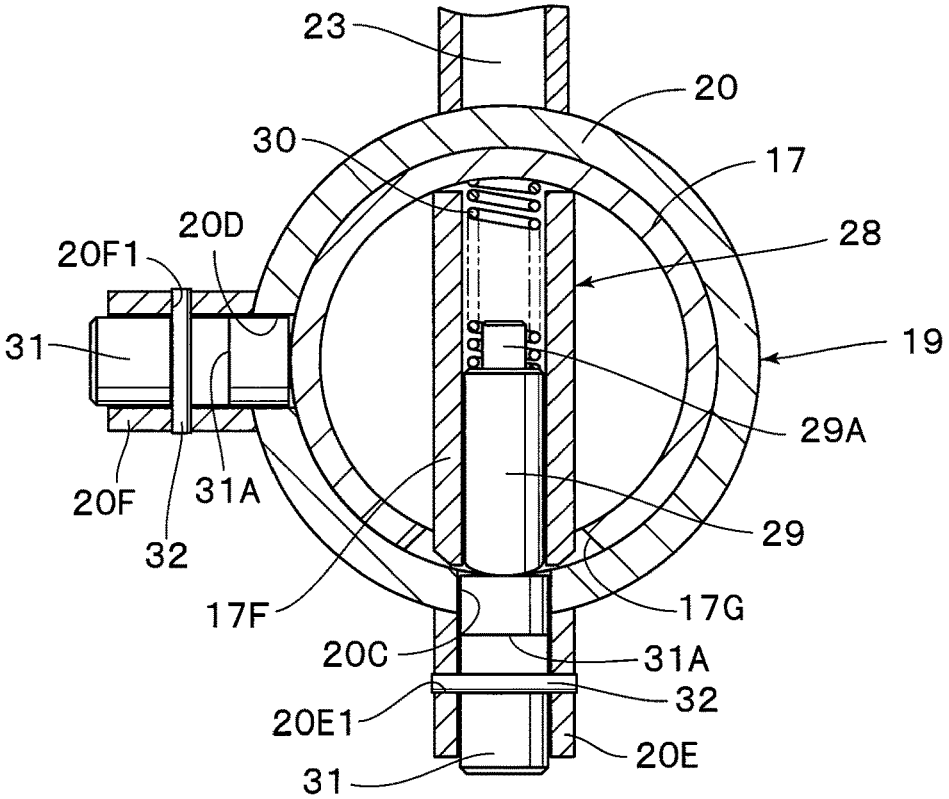
FIG. 12 is a cross section showing, in the same position as in FIG. 9, a state where the engaging pin is separated from a first arm side stopper hole by a bush pin.

When the arm member 19 moves to the cab-lateral storage position, as shown in FIG. 10 the engaging pin 29 of the stopper 28 is engaged with the first arm side stopper hole 20C by the compression spring 30. Thereby, the engaging pin 29 abuts on the bush pin 31 to project the bush pin 31 from the first collar 20E. At this time, the recessed groove 31A of the bush pin 31 abuts on the retaining pin 32 to retain the bush pin 31 within the first collar 20E. A worker pushes the bush pin 31 projected from the first collar 20E into the first collar 20E in this state. Thereby, as shown in FIG. 12 the engaging pin 29 is pushed into the shaft body side stopper hole 17F against the compression spring 30 to be separated from the first arm side stopper hole 20C. As a result, the arm member 19 can be rotated relative to the cable stand 16.

As similar to this, as shown in FIG. 11, when the arm member 19 moves to the cab-backward storage position, the engaging pin 29 of the stopper 28 is engaged with the second arm side stopper hole 20D by the compression spring 30 to project the bush pin 31 from the second collar 20F. At this time, the recessed groove 31A of the bush pin 31 abuts on the retaining pin 32 attached in the pin hole 20F1 of the second collar 20F to retain the bush pin 31 within the second collar 20F. A worker pushes the bush pin 31 into the second collar 20F in this state. Thereby, the engaging pin 29 is separated from the second arm side stopper hole 20D. As a result, the arm member 19 can be rotated relative to the cable stand 16.

Figure 7:
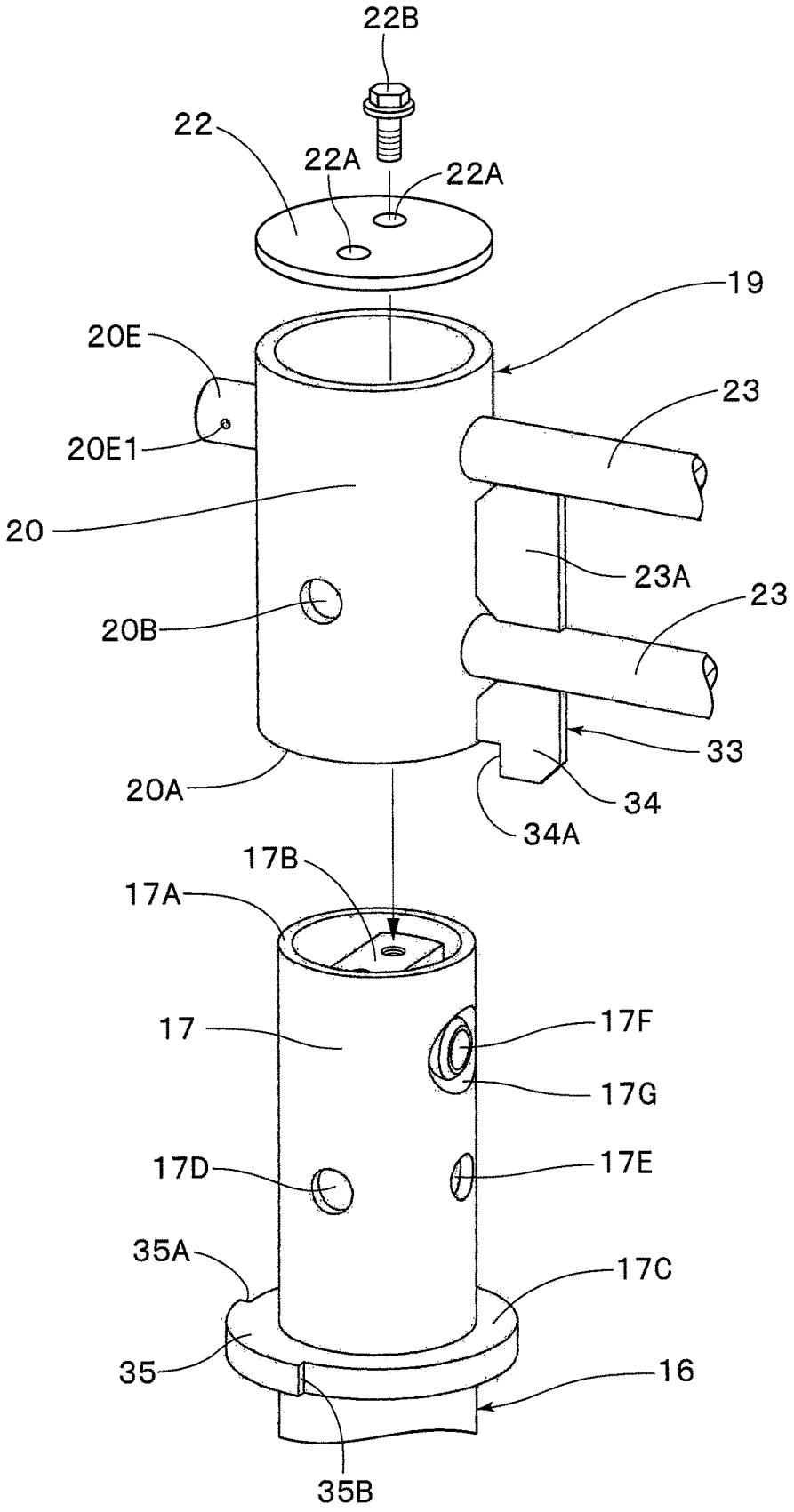
FIG. 7 is an exploded perspective view showing a cable stand and the arm member.

The rotation restricting portion 33 is disposed between the cable stand 16 and the arm member 19. The rotation restricting portion 33 restricts the arm member 19 from rotating to the cab 6-side over the cab-lateral storage position or the cab-backward storage position. As shown in FIG. 7, the rotation restricting portion 33 includes an arm side projection 34 disposed in the cylindrical part 20 of the arm member 19, and a shaft body side projection 35 disposed in the flange part 17C of the stand main body 17.

The arm side projection 34 is fixed in the lower section of the stay 23 on the outer peripheral surface of the cylindrical part 20 by welding or the like. The arm side projection 34 is formed as a plate body projecting downward from the lower end 20A of the cylindrical part 20. A notch part 34A is disposed in the lower end side of the arm side projection 34 to rotate along the outer peripheral surface of the flange part 17C disposed in the stand main body 17.

The shaft body side projection 35 is disposed on the outer peripheral surface of the flange part 17C. Specifically, the shaft body side projection 35 is formed to be integral with the flange part 17C as an arc-shaped projection part projecting the outer peripheral surface of the flange part 17C partially to the radial outside. The shaft body side projection 35 is formed in an arc shape of 90 degrees about the shaft center A-A of the cable stand 16, and a radius of the outer peripheral surface of the shaft body side projection 35 about the shaft center A-A is set to be larger than a radius of the outer peripheral surface of the flange part 17C. When the notch part 34A of the arm side projection 34 is in a position corresponding to the outer peripheral surface of the flange part 17C, the arm member 19 rotates relative to the cable stand 16. The notch part 34A of the arm side projection 34 abuts on the shaft body side projection 35 disposed in the flange part 17C, thereby restricting the rotation of the arm member 19.

In the present embodiment, when the arm member 19 is rotated to the cab 6-side from the cab-lateral storage position (position in FIG. 5), the notch part 34A of the arm side projection 34 abuts on one end 35A of the shaft body side projection 35 in the circumferential direction. In addition, when the arm member 19 is rotated to the cab 6-side from the cab-backward storage position (position in FIG. 6), the notch part 34A of the arm side projection 34 abuts on the other end 35B of the shaft body side projection 35 in the circumferential direction. Accordingly, the arm member 19 does not rotate to the cab 6-side over the cab-backward storage position but the arm member 19 does not rotate to the cab 6-side over the cab-lateral storage position. As a result, the arm member 19 is rotatable within a range of 270 degrees, in which the shaft body side projection 35 is not disposed, of the flange part 17C.

The electric hydraulic excavator 1 according to the present embodiment has the configuration as described above, and hereinafter, an explanation will be made of the operation of the electric hydraulic excavator 1.

In a case where the external power source is in the working site, the power feeding cable 13 extending from the external power source is connected to the power feeding port 12 of the electric hydraulic excavator 1. Thereby, the power from the external power source is supplied via the motor controlling device and the like (not shown) to the electric motor 9, and the electric motor 9 drives the hydraulic pump 10 by the power from the external power source.

An operator operates the traveling lever pedal (not shown) at this state, thereby causing the electric hydraulic excavator 1 to travel to the working site. After the electric hydraulic excavator 1 moves to the working site, the operator operates the working lever pedal (not shown), making it possible to carry out the excavating work of earth and sand and the like by the working mechanism 4 while revolving the upper revolving structure 3. The battery 11 is charged with part of the power from the external power source (extra power). At this time, the intermediate section of the power feeding cable 13 connected to the power feeding port 12 is supported by the cable support device 14.

Next, an explanation will be made of the work of supporting the intermediate section of the power feeding cable 13 by the cable support device 14.

First, the arm member 19 is rotated to the cable gripping position as shown in FIG. 2 about the shaft center A-A of the cable stand 16. When the arm member 19 reaches the cable gripping position, the arm side lock holes 20B of the cylindrical part 20 correspond to the first shaft body side lock holes 17D of the stand main body 17. At this state, the lock pin 26 is inserted in the arm side lock holes 20B and the first shaft body side lock holes 17D. In addition, the ring pin 27 is inserted in the pin hole 26B on the tip end side of the lock pin 26 projecting from the outer peripheral surface of the cylindrical part 20. Thereby, the lock pin 26 is prevented from axially falling out to fix the arm member 19 in the cable gripping position.

At this state, the intermediate section of the power feeding cable 13 is held into between the clamp members 24A, 24B of the cable clamp 24 attached in the stay 23 of the arm member 19 for the gripping, and the clamp members 24A, 24B are fixed in the closed position by the lock 24C. Thereby, the intermediate section of the power feeding cable 13 is gripped in the tip end of the stay 23 projecting backward from the counterweight 7. In this way, the clamp members 24A, 24B of the cable clamp 24 are set in the closed position to retain the power feeding cable 13 therebetween. Thereby, the power feeding cable 13 can easily be gripped to quickly carry out the work of supporting the power feeding cable 13 by the cable support device 14. On the other hand, the rotation of the arm member 19 relative to the cable stand 16 is prohibited by the locking mechanism 25 composed of the arm side lock holes 20B, the first shaft body side lock holes 17D, the lock pin 26, and the like to fix the arm member 19 in the cable gripping position. As a result, regardless of the traveling movement of the electric hydraulic excavator 1 and the revolving movement of the upper revolving structure 3 a sufficient interval is always secured between the power feeding cable 13 and the electric hydraulic excavator 1.

As a result, at the traveling of the electric hydraulic excavator 1, the power feeding cable 13 can be prevented from being stepped on by the lower traveling structure 2 to protect the power feeding cable 13. In addition, at the revolving of the upper revolving structure 3, the tip end of the stay 23 does not approach the cab 6, making it possible to prevent the power feeding cable 13 retained in the tip end (cable clamp 24) of the stay 23 from contacting the cab 6 to protect the power feeding cable 13.

Next, in a case where the electric hydraulic excavator 1 operates by the power charged in the battery 11, the power feeding cable 13 from the external power source is removed from the power feeding port 12. In this case, the clamp members 24A, 24B are moved to the opened position by unlocking the lock 24C of the cable clamp 24. Thereby, the power feeding cable 13 can easily be released from the cable clamp 24, and the removal work of the power feeding cable 13 from the cable support device 14 can quickly be carried out. On the other hand, the arm member 19 of the cable support device 14 is fixed in the cab-lateral storage position as shown in FIG. 5 in such a manner of being out of the way of the revolving movement of the upper revolving structure 3 and the movement of the working mechanism 4. That is, by pulling out the lock pin 26 from the arm member 19 fixed in the cable gripping position, the arm member 19 is rotated by 180 degrees counterclockwise relative to the cable stand 16.

When the arm member 19 is in the cable gripping position, as shown in FIG. 9 the engaging pin 29 disposed within the shaft body side stopper hole 17F of the stand main body 17 is pushed against the inner peripheral surface of the cylindrical part 20 by the compression spring 30. When the arm member 19 is rotated by 180 degrees counterclockwise from the cable gripping position in this state, as shown in FIG. 10 the first arm side stopper hole 20C and the first collar 20E of the cylindrical part 20 correspond to the shaft body side stopper hole 17F of the stand main body 17. Accordingly, the engaging pin 29 projects from the shaft body side stopper hole 17F by the compression spring 30 and is engaged with the first arm side stopper hole 20C. In this way, the arm member 19 rotating relative to the cable stand 16 automatically stops in the cab-lateral storage position by the stopper 28 composed of the shaft body side stopper hole 17F, the first arm side stopper hole 20C, the engaging pin 29, the compression spring 30 and the like.

At this time, the bush pin 31 disposed in the first collar 20E is pressed by the engaging pin 29 to project from the first collar 20E. The recessed groove 31A formed in the bush pin 31 abuts on the retaining pin 32 attached in the first collar 20E. Thereby, the movement of the bush pin 31 is restricted and stops in a position where the engaging pin 29 is engaged with the first arm side stopper hole 20C. Therefore, the arm member 19 can be retained in the cab-lateral storage position.

When the arm member 19 stops in the cab-lateral storage position by the stopper 28, the arm side lock hole 20B of the cylindrical part 20 corresponds to the first shaft body side lock hole 17D of the stand main body 17. At this state, the lock pin 26 is inserted in the arm side lock hole 20B and the first shaft body side lock hole 17D, and the lock pin 26 is prevented from axially falling out by the ring pin 27. Thereby, in a case where the arm member 19 is fixed in the cab-lateral storage position and the electric hydraulic excavator 1 operates by the power charged in the battery 11, the movement of the working mechanism 4 can be prevented from being interrupted by the cable support device 14.

Next, an explanation will be made of the work of retaining the arm member 19 in the cab-lateral storage position as shown in FIG. 6 for loading the electric hydraulic excavator 1 on the transport vehicle, for example. It should be noted that it is possible to load the electric hydraulic excavator 1 on the transport vehicle in a state where the arm member 19 is fixed in the cab-lateral storage position.

In a case of moving the arm member 19 from the cab-lateral storage position to the cab-backward storage position, the lock pin 26 is pulled out from the arm member 19 fixed in the cab-lateral storage position. Next, as shown in FIG. 12 the bush pin 31 projecting from the first collar 20E is pushed into the first collar 20E. The engaging pin 29 abutting on the bush pin 31 is pushed into the shaft body side stopper hole 17F against the compression spring 30 and is separated from the first arm side stopper hole 20C of the cylindrical part 20. Thereby, the arm member 19 is made rotatable relative to the cable stand 16.

At this time, for example in a case where the arm member 19 is swung by strong wind to be rotated to the cab 6-side over the cab-lateral storage position, the tip end of the stay 23 possibly collides with the cab 6. On the other hand, the cable support device 14 is provided with the rotation restricting portion 33. The rotation restricting portion 33 restricts the arm member 19 from rotating to the cab 6-side over the cab-lateral storage position. That is, in a position where the arm member 19 is rotated to the cab 6-side slightly from the cab-lateral storage position, the notch part 34A of the arm side projection 34 abuts on the one end 35A of the shaft body side projection 35 in the circumferential direction. Thereby, the arm member 19 is restricted from rotating to the cab 6-side over the cab-lateral storage position, making it possible to prevent the collision between the stay 23 and the cab 6.

Next, in a state where the engaging pin 29 is separated from the first arm side stopper hole 20C of the cylindrical part 20, the arm member 19 is rotated by 270 degrees clockwise relative to the cable stand 16. Thereby, as shown in FIG. 11 the second arm side stopper hole 20D and the second collar 20F of the cylindrical part 20 correspond to the shaft body side stopper hole 17F of the stand main body 17. The engaging pin 29 projects from the shaft body side stopper hole 17F by the compression spring 30 to be engaged with the second arm side stopper hole 20D. In this way, the arm member 19 automatically stops in the cab-backward storage position (position in FIG. 6) by the stopper 28.

At this time, the bush pin 31 disposed in the second collar 20F is pressed by the engaging pin 29 and the recessed groove 31A abuts on the retaining pin 32 attached in the second collar 20F. Thereby, the engaging pin 29 stops in a position of being engaged with the first arm side stopper hole 20C and the arm member 19 is retained in the cab-backward storage position. When the arm member 19 stops in the cab-backward storage position, the arm side lock hole 20B of the cylindrical part 20 corresponds to the second shaft body side lock hole 17E of the stand main body 17. At this state, the lock pin 26 is inserted in the arm side lock hole 20B and the second shaft body side lock hole 17E and the lock pin 26 is prevented from axially falling out by the ring pin 27. Thereby, the arm member 19 is fixed in the cab-backward storage position, and when the electric hydraulic excavator 1 is loaded on the transport vehicle, the arm member 19 can be prevented from inadvertently rotating to interfere with obstacles in the surroundings. As a result, it is possible to improve the workability at the transporting of the electric hydraulic excavator 1.

After the electric hydraulic excavator 1 is transported to the working site, in a case where the arm member 19 is moved from the cab-backward storage position to the cable gripping position, the lock pin 26 is pulled out from the arm member 19 fixed in the cab-backward storage position. Next, by pushing the bush pin 31 into the second collar 20F, the engaging pin 29 is separated from the second arm side stopper hole 20D of the cylindrical part 20. Thereby, the arm member 19 is made rotatable relative to the cable stand 16. Here, assuming that the arm member 19 is rotated to the cab 6-side slightly from the cab-backward storage position, the notch part 34A of the arm side projection 34 abuts on the other end 35B of the shaft body side projection 35 in the circumferential direction. Thereby, the arm member 19 is restricted from rotating to the cab 6-side over the cab-backward storage position, making it possible to prevent the collision between the stay 23 and the cab 6.

In addition, when the arm member 19 reaches the cable gripping position by rotating the arm member 19 by 90 degrees counterclockwise from the cab-backward storage position, the arm side lock hole 20B of the cylindrical part 20 corresponds to the first shaft body side lock hole 17D of the stand main body 17. At this state, the lock pin 26 is inserted in the arm side lock hole 20B and the first shaft body side lock hole 17D and the lock pin 26 is prevented from axially falling out by the ring pin 27. Thereby, the arm member 19 is fixed in the cable gripping position.

Thus, according to the present embodiment the electric hydraulic excavator 1 is provided with the cable support device 14 disposed on the upper revolving structure 3 to support the intermediate part of the power feeding cable 13, wherein the cable support device 14 includes; the cable stand 16 that is attached on the upper revolving structure 3 in a state where the shaft center A-A extends in the upper-lower direction; the arm member 19 that is attached on the cable stand 16 to be rotatable about the shaft center A-A and grips the power feeding cable 13 on the tip end side; and the locking mechanism 25 disposed to be removable between the cable stand 16 and the arm member 19 to prohibit the rotation of the arm member 19 relative to the cable stand 16.

According to this configuration, the rotation of the arm member 19 relative to the cable stand 16 attached on the upper revolving structure 3 is prohibited by the locking mechanism 25, making it possible to fix the arm member 19 to the upper revolving structure 3. As a result, the power feeding cable 13 gripped by the arm member 19 can be prevented from contacting the structural object such as the cab 6 at the revolving of the upper revolving structure 3 to protect the power feeding cable 13. In addition, also in a case of loading the electric hydraulic excavator 1 on the transport vehicle for transport, the arm member 19 can be prevented from interfering with the obstacle in the surroundings by prohibiting the rotation of the arm member 19 by the locking mechanism 25.

In the embodiment, the arm member 19 is provided with the cylindrical part 20 rotatably fitted in the cable stand 16, wherein the locking mechanism 25 includes the first shaft body side lock holes 17D and the second shaft body side lock holes 17E that are arranged to penetrate through the cable stand 16 in the radial direction of the cable stand 16, the arm side lock holes 20B that are disposed to penetrate through the cylindrical part 20 in the radial direction of the cylindrical part 20 and correspond to the first shaft body side lock holes 17D or the second shaft body side lock holes 17E by the rotation of the cylindrical part 20 relative to the cable stand 16, and the lock pin 26 to be inserted in the first shaft body side lock holes 17D or the second shaft body side lock holes 17E and the arm side lock holes 20B. According to this configuration, only by inserting the lock pin 26 in the first shaft body side lock holes 17D or the second shaft body side lock holes 17E of the cable stand 16 and the arm side lock holes 20B of the cylindrical part 20, the rotation of the arm member 19 can be prohibited. Accordingly, in comparison with a case of prohibiting the rotation of the arm member by using exclusive jigs, tools or the like, the workability can be enhanced.

In the embodiment, the stopper 28 is disposed between the cable stand 16 and the arm member 19 to automatically stop the arm member 19 rotating relative to the cable stand 16 in a predetermined position. According to this configuration, in a case where the structural object of the cab 6 or the like interfering with the arm member 19 is present within a range in which the arm member 19 rotates, the rotation of the arm member 19 can be stopped by the stopper 28 in a position where the arm member 19 does not interfere with the cab 6.

In the embodiment, the arm member 19 is provided with the cylindrical part 20 rotatably fitted in the cable stand 16, wherein the stopper 28 includes the shaft body side stopper hole 17F that opens to the outer peripheral surface of the cable stand 16 and extends in the radial direction of the cable stand 16, the first arm side stopper hole 20C and the second arm side stopper hole 20D that are disposed in the cylindrical part 20 and correspond to the shaft body side stopper hole 17F by the rotation of the cylindrical part 20 relative to the cable stand 16, the engaging pin 29 disposed to be movable within the shaft body side stopper hole 17F, and the compression spring 30 for urging the engaging pin 29 in a direction of projecting from the shaft body side stopper hole 17F to engage the engaging pin 29 with the first arm side stopper hole 20C or the second arm side stopper hole 20D. According to this configuration, when the arm member 19 rotates and the first arm side stopper hole 20C or the second arm side stopper hole 20D corresponds to the shaft body side stopper hole 17F, the engaging pin 29 projects from the shaft body side stopper hole 17F by the compression spring 30 and is engaged with the first arm side stopper hole 20C or the second arm side stopper hole 20D. As a result, the rotation of the arm member 19 can automatically be stopped by the stopper 28.

In the embodiment, the cylindrical first collar 20E concentrical with the first arm side stopper hole 20C and together with it, the cylindrical second collar 20F concentrical with the second arm side stopper hole 20D are disposed on the outer peripheral surface of the cylindrical part 20. The bush pin 31 is disposed on the inner peripheral side on the first collar 20E and the second collar 20F to push the engaging pin 29 engaging with the first arm side stopper hole 20C or the second arm side stopper hole 20D into the shaft body side stopper hole 17F against the compression spring 30. According to this configuration, only by pushing the engaging pin 29 into the shaft body side stopper hole 17F by the bush pin 31, the engaging pin 29 can easily be separated from the first arm side stopper hole 20C or the second arm side stopper hole 20D and the arm member 19 can be rotated relative to the cable stand 16.

In the embodiment, the cab 6 is disposed on the upper revolving structure 3 to form the operator's room therein and the arm member 19 is fixed by the locking mechanism 25 in the cab-lateral storage position of being disposed along the right side surface 6D of the cab 6 and in the cab-backward storage position of being disposed along the rear surface 6B of the cab 6. According to this configuration, for example in a case of operating the electric hydraulic excavator 1 by the power charged in the battery 11, when the arm member 19 is fixed in the cab-lateral storage position, the movement of the working mechanism 4 can be prevented from being interrupted by the arm member 19. In addition, when the electric hydraulic excavator 1 is loaded on the transport vehicle, at the transporting the arm member 19 can be prevented from interfering with obstacles in the surroundings by fixing the arm member 19 in the cab-backward storage position.

In the embodiment, the rotation restricting portion 33 is disposed between the cable stand 16 and the arm member 19 to restrict the arm member 19 from rotating to the cab 6-side over the cab-lateral storage position or the cab-backward storage position. According to this configuration, when the arm member 19 fixed in the cab-lateral storage position or in the cab-backward storage position is made rotatable, for example even when the arm member 19 is blown up by strong wind, the rotation restricting portion 33 can restrict the arm member 19 from rotating to the cab 6-side. Thereby, the arm member 19 can be prevented from colliding with the cab 6.

In the embodiment, the disc-shaped flange part 17C having a large diameter is disposed in the intermediate section of the cable stand 16 in the upper-lower direction, and the arm member 19 is provided with the cylindrical part 20 that is rotatably fitted in the cable stand 16 and of which the lower end 20A abuts on the flange part 17C. The rotation restricting portion 33 includes the arm side projection 34 that projects downward from the cylindrical part 20 and rotates along the outer peripheral surface of the flange part 17C, and the shaft body side projection 35 that is disposed to project on the outer peripheral surface of the flange part 17C and on which the arm side projection 34 abuts. According to this configuration, when the arm member 19 rotates relative to the cable stand 16, the arm side projection 34 abuts on the shaft body side projection 35 while rotating along the outer peripheral surface of the flange part 17C. Thereby, the rotation of the arm member 19 can certainly be restricted.

In the embodiment, the cable clamp 24 is disposed on the tip end side of the arm member 19 to open or close between the closed position of gripping the power feeding cable 13 and the opened position of releasing the power feeding cable 13. According to this configuration, by setting the cable clamp 24 in the closed position for holding the power feeding cable 13 therein, the power feeding cable 13 can easily be gripped to quickly carry out the work of supporting the power feeding cable 13 by the cable support device 14. On the other hand, by setting the cable clamp 24 in the opened position, the power feeding cable 13 can easily be released to quickly carry out the removal work of the power feeding cable 13 from the cable support device 14.

It should be noted that the embodiment shows as an example the electric hydraulic excavator 1 in the form in which the battery 11 is mounted on the upper revolving structure 3, the electric motor 9 is driven by the power from the external power source and the electric motor 9 is driven also by the power charged in the battery 11. However, the present invention is not limited thereto, but may be applied, for example, also to an electric construction machine in the form in which a battery is not mounted and an electric motor is driven only by the power from the external power source.

The embodiment shows an example of two positions composed of the cab-backward storage position and the cab-lateral storage position as the position of automatically stopping the rotation of the arm member 19 by the stopper 28. However, the present invention is not limited thereto, but may be applied, for example, to the configuration of stopping the rotation of the arm member 19 by the stopper 28 in three positions of a cable gripping position together with a cab-backward storage position and a cab-lateral storage position.

The embodiment shows as an example the shaft body side projection 35 in the arc shape formed to be integral with the flange part 17C of the stand main body 17 as a shaft body side projection configuring the rotation restricting portion 33. However, the present invention is not limited thereto, but may be applied, for example, to the configuration of arranging two shaft body side projections corresponding to a cab-backward storage position and a cab-lateral storage position on the outer peripheral surface of the flange part 17C.

DESCRIPTION OF REFERENCE NUMERALS

2: LOWER TRAVELING STRUCTURE
3: UPPER REVOLVING STRUCTURE
6: CAB
6B: REAR SURFACE
6D: RIGHT SIDE SURFACE
9: ELECTRIC MOTOR
13: POWER FEEDING CABLE
14: CABLE SUPPORT DEVICE
16: CABLE STAND (CABLE BODY)
17C: FLANGE PART
17D: FIRST SHAFT BODY SIDE LOCK HOLE (SHAFT BODY SIDE LOCK HOLE)
17E: SECOND SHAFT BODY SIDE LOCK HOLE (SHAFT BODY SIDE LOCK HOLE)
17F: SHAFT BODY SIDE STOPPER HOLE
19: ARM MEMBER
20: CYLINDRICAL PART
20B: ARM SIDE LOCK HOLE
20C: FIRST ARM SIDE STOPPER HOLE (ARM SIDE STOPPER HOLE)
20D: SECOND ARM SIDE STOPPER HOLE (ARM SIDE STOPPER HOLE)
20E: FIRST COLLAR (COLLAR)
20F: SECOND COLLAR (COLLAR)
24: CABLE CLAMP
25: LOCKING MECHANISM
26: LOCK PIN
28: STOPPER
29: ENGAGING PIN
30: COMPRESSION SPRING (PIN URGING MEMBER)
31: BUSH PIN
33: ROTATION RESTRICTING PORTION
34: ARM SIDE PROJECTION
35: SHAFT BODY SIDE PROJECTION

The invention claimed is:

1. An electric construction machine comprising:
an automotive lower traveling structure;
an upper revolving structure mounted on the lower traveling structure to be capable of revolving thereto;
an electric motor as a power source disposed on the upper revolving structure; and
a cable support device configured to support an intermediate part of a power feeding cable for supplying power from an external power source to the electric motor, wherein
the cable support device includes:
a shaft body that is attached on the upper revolving structure in a state where a shaft center of the shaft body extends in an upper-lower direction;
an arm member that is attached on the shaft body to be rotatable about the shaft center and grips the power feeding cable on the tip end side; and
a locking mechanism disposed to be removable between the shaft body and the arm member to prohibit rotation of the arm member relative to the shaft body, wherein
a stopper disposed between the shaft body and the arm member to automatically stop the arm member rotating relative to the shaft body in a predetermined position;
the arm member comprises a cylindrical part rotatably fitted in the shaft body; and
the stopper includes:
a shaft body side stopper hole that opens to an outer peripheral surface of the shaft body and extends in a radial direction of the shaft body;
an arm side stopper hole that is disposed in the cylindrical part and corresponds to the shaft body side stopper hole by rotation of the cylindrical part relative to the shaft body;
an engaging pin disposed to be movable within the shaft body side stopper hole; and
a pin urging member for urging the engaging pin in a direction of projecting from the shaft body side stopper hole, the pin urging member engaging the engaging pin with the arm side stopper hole when the arm side stopper hole corresponds to the shaft body side stopper hole.

2. The electric construction machine according to claim 1, wherein
the locking mechanism includes:
a shaft body side lock hole disposed to penetrate through the shaft body in a radial direction of the shaft body;
an arm side lock hole that is disposed to penetrate through the cylindrical part in a radial direction of the cylindrical part and corresponds to the shaft body side lock hole by rotation of the cylindrical part relative to the shaft body; and
a lock pin to be inserted in the shaft body side lock hole and the arm side lock hole.

3. The electric construction machine according to claim 1, further comprising:
a cylindrical collar disposed to be concentrical with the arm side stopper hole on an outer peripheral surface of the cylindrical part; and
a bush pin disposed on an inner peripheral side of the cylindrical collar to push the engaging pin engaging with the arm side stopper hole into the shaft body side stopper hole against the pin urging member.

4. An electric construction machine comprising:

an automotive lower traveling structure;

an upper revolving structure mounted on the lower traveling structure to be capable of revolving thereto;

an electric motor as a power source disposed on the upper revolving structure; and a cable support device configured to support an intermediate part of a power feeding cable for supplying power from an external power source to the electric motor, wherein the cable support device includes:

a shaft body that is attached on the upper revolving structure in a state where a shaft center of the shaft body extends in an upper-lower direction;

an arm member that is attached on the shaft body to be rotatable about the shaft center and grips the power feeding cable on the tip end side; and a locking mechanism disposed to be removable between the shaft body and the arm member to prohibit rotation of the arm member relative to the shaft body, wherein a cab disposed on the upper revolving structure to form an operator's room therein, wherein the arm member is fixed by the locking mechanism in a cab-lateral storage position of being disposed along a side surface of the cab and in a cab-backward storage position of being disposed along a rear surface of the cab.

5. The electric construction machine according to claim 4, further comprising:

a rotation restricting portion disposed between the shaft body and the arm member to restrict the arm member from rotating to the cab side over the cab-lateral storage position or the cab-backward storage position.

6. The electric construction machine according to claim 5, further comprising:

a disc-shaped flange part disposed in an intermediate section of the shaft body in the upper-lower direction, the disc-shaped flange part having a larger diameter than the shaft body, wherein the arm member comprises a cylindrical part that is rotatably fitted in the shaft body and of which a lower end abuts on the flange part, and the rotation restricting portion includes:

an arm side projection that projects downward from the cylindrical part and rotates along an outer peripheral surface of the flange part; and a shaft body side projection that is disposed to project on the outer peripheral surface of the flange part and on which the arm side projection abuts.

7. The electric construction machine according to claim 1, further comprising:

a cable clamp disposed on the tip end side of the arm member to open or close between a closed position of gripping the power feeding cable and an opened position of releasing the power feeding cable.

8. The electric construction machine according to claim 4, wherein the arm member comprises a cylindrical part rotatably fitted in the shaft body; and the locking mechanism includes:

a shaft body side lock hole disposed to penetrate through the shaft body in a radial direction of the shaft body;

an arm side lock hole that is disposed to penetrate through the cylindrical part in a radial direction of the cylindrical part and corresponds to the shaft body side lock hole by rotation of the cylindrical part relative to the shaft body; and a lock pin to be inserted in the shaft body side lock hole and the arm side lock hole.

9. The electric construction machine according to claim 4, further comprising:

a cable clamp disposed on the tip end side of the arm member to open or close between a closed position of gripping the power feeding cable and an opened position of releasing the power feeding cable.

* * * * *